US008500048B2

(12) United States Patent
Potter

(10) Patent No.: US 8,500,048 B2
(45) Date of Patent: Aug. 6, 2013

(54) PROCESS AND APPARATUS FOR DRYING AND POWDERIZING MATERIAL

(75) Inventor: Patrick Potter, Hamilton (NZ)

(73) Assignee: Cake Energy, LLC, Mission Viejo, CA (US)

( * ) Notice: Subject to any disclaimer, the term of this patent is extended or adjusted under 35 U.S.C. 154(b) by 315 days.

(21) Appl. No.: 12/503,044

(22) Filed: Jul. 14, 2009

(65) Prior Publication Data

US 2010/0006680 A1 Jan. 14, 2010

Related U.S. Application Data

(60) Provisional application No. 61/080,466, filed on Jul. 14, 2008.

(51) Int. Cl.
*B02C 21/00* (2006.01)
*B02C 23/00* (2006.01)
*B02C 13/10* (2006.01)

(52) U.S. Cl.
USPC ..... 241/23; 241/57; 241/138; 241/146; 241/163; 241/191; 241/292.1

(58) Field of Classification Search
USPC ..... 241/23, 56, 65, 57, 138, 146, 163, 241/191, 261, 292.1
See application file for complete search history.

(56) References Cited

U.S. PATENT DOCUMENTS

| | | | | |
|---|---|---|---|---|
| 2,699,898 | A * | 1/1955 | Rogers | 241/43 |
| 3,966,126 | A | 6/1976 | Werner | |
| 4,009,180 | A | 2/1977 | Deucker et al. | |
| 4,243,180 | A | 1/1981 | Bonnel | |
| 4,498,632 | A | 2/1985 | Ruter | |
| 4,728,044 | A | 3/1988 | Duill et al. | |
| 4,869,433 | A | 9/1989 | Lewellin | |
| 5,324,142 | A | 6/1994 | Haig | |
| 5,971,302 | A | 10/1999 | Doumet | |
| 6,125,774 | A | 10/2000 | Kohler et al. | |
| 2001/0015389 | A1 | 8/2001 | Kriebel et al. | |
| 2003/0164419 | A1 | 9/2003 | Takano et al. | |
| 2003/0168537 | A1 | 9/2003 | Hart et al. | |
| 2005/0103908 | A1 | 5/2005 | Muther et al. | |
| 2005/0145728 | A1 | 7/2005 | Huttlin | |
| 2008/0041981 | A1 | 2/2008 | Garrison | |

(Continued)

OTHER PUBLICATIONS

International Search Report and Written Opinion dated Sep. 10, 2009 for corresponding PCT Application No. PCT/US2009/050605.
Register of Patents—File History for New Zealand Patent Application Entitled Improvements in Pulverisers; Patent No. 155650; Registered Jun. 8, 1970; Applicant Patrick Potter; 22 pages.

(Continued)

*Primary Examiner* — Faye Francis
(74) *Attorney, Agent, or Firm* — Christie, Parker & Hale, LLP

(57) ABSTRACT

An apparatus for drying and powderizing organic material. The apparatus includes at least one chamber including: an intake adapted to receive warm air and the material into the at least one chamber, and an outlet adapted to transport warm air and powder out of the at least one chamber; at least one rotatable drive shaft in the at least one chamber adapted to rotated; and at least one blade assembly on the at least one drive shaft. The blade assembly includes a blade hub about the rotatable drive shaft and at least one blade coupled to the blade hub, wherein the at least one blade is adapted to powderize the material to expose a surface of the material to the warm air so that moisture in the material evaporates into the warm air.

23 Claims, 9 Drawing Sheets

U.S. PATENT DOCUMENTS

| | | | |
|---|---|---|---|
| 2008/0041998 | A1 | 2/2008 | Gillis |
| 2008/0173738 | A1 | 7/2008 | Montag |
| 2008/0272219 | A1 | 11/2008 | Kjaersgaard |
| 2009/0140091 | A1 | 6/2009 | Doppstadt et al. |
| 2009/0166452 | A1 | 7/2009 | Hundebol |
| 2009/0212140 | A1 | 8/2009 | Ritzenthaler |
| 2010/0000119 | A1 | 1/2010 | Ueno et al. |
| 2010/0102150 | A1 | 4/2010 | Maeda et al. |
| 2010/0127105 | A1 | 5/2010 | Nied et al. |
| 2010/0187340 | A1 | 7/2010 | Potter |

OTHER PUBLICATIONS

Patent Act 1953 Complete Specification of New Zealand Patent No. 299036 Entitled Sludge Total Energy Recuperator Module (Sterm); Registered Oct. 3, 1997; Applicant Patrick Potter; dated Oct. 1, 2010; 17 pages.

New Zealand Patents Act 1953; Complete Specification of New Zealand Patent No. 561417 Entitled Drying and Milling Apparatus and Processing Plant; dated Sep. 13, 2007; Applicant Enviro-Energy Limited; 23 pages.

* cited by examiner

PROCESS AND APPARATUS FOR DRYING AND POWDERIZING MATERIAL

CROSS-REFERENCE TO RELATED APPLICATION(S)

This application claims priority to and the benefit of U.S. Provisional Patent Application No. 61/080,466, filed on Jul. 14, 2008, in the U.S. Patent and Trademark Office, the entire content of which is incorporated herein by reference. The entire content of U.S. Patent Applications ENERGY RECOVERY AND TRANSFER SYSTEM AND PROCESS (Application Ser. No. 12/503,038), HEAT RECOVERY AND PRESSURE CONTROL UNIT (Application Ser. No. 12/503,030), and METHOD AND APPARATUS FOR STERILIZING AND DEODORIZING AIR (Application Ser. No. 12/503,027) filed on Jul. 14, 2009 in the U.S. Patent and Trademark Office is incorporated herein by reference.

FIELD OF THE INVENTION

The present invention relates a process and apparatus for drying and powderizing material.

BACKGROUND OF THE INVENTION

Animal byproduct meals, fecal material, agricultural fertilizer, corn byproducts, wheat byproducts, wood chips, saw dust, blood, bio-solids, milk powder, lime, coal, seaweed, and the like are high moisture content materials that may provide a rich source of energy when effectively dehydrated and powdered.

Therefore, there is a need for a process and system for drying and powderizing these materials.

SUMMARY OF THE INVENTION

An embodiment of the present invention provides an apparatus for drying and powderizing organic material. The apparatus includes at least one chamber including: an intake adapted to receive warm air and the material into the at least one chamber, and an outlet adapted to transport warm air and powder out of the at least one chamber; at least one rotatable drive shaft in the at least one chamber adapted to be rotatable; and at least one blade assembly on the at least one rotatable drive shaft. The blade assembly includes a blade hub about the at least one rotatable drive shaft and at least one blade coupled to the blade hub, wherein the at least one blade is adapted to powderize the material to expose a surface of the material to the warm air so that moisture in the material evaporates into the warm air.

The apparatus may further include at least one flat blade assembly on the at least one rotatable drive shaft, the flat blade assembly including a flat blade hub about the at least one rotatable drive shaft and at least one flat blade coupled to the flat blade hub, wherein the at least one flat blade is adapted to pre-break the material to expose a surface of the material to the warm air so that moisture in the material evaporates into the warm air. The apparatus may further include at least one fixed blade assembly on an interior wall of the at least one chamber and adjacent to the at least one flat blade, wherein the fixed blade assembly includes at least one fixed blade and is adapted to pre-break the material between the at least one flat blade and the at least one fixed blade. The apparatus may further include at least one angled blade assembly on the at least one rotatable drive shaft, the angled blade assembly including an angled blade hub about the at at least one rotatable drive shaft and at least one angled blade coupled to the angled blade hub, wherein the at least one angled blade is adapted to transport the material through the at least one chamber and powderize the material. The apparatus may further include at least one paddle assembly on the at least one rotatable drive shaft, the paddle assembly comprising a paddle hub about the at least one rotatable drive shaft and at least one paddle coupled to the paddle hub, wherein the at least one paddle is adapted to accelerate the powder and transport the powder through the outlet.

The flat blade assembly may include twelve flat blades on the flat blade hub, wherein an angle between each of the flat blades is 30 degrees. The angled blade assembly may include twelve angled blades on the angled blade hub at an angle of seven degrees to the longitudinal axis of the at least one rotatable drive shaft, wherein an angle between each of the angled blades is 30 degrees. The paddle assembly may include 8 paddles on the paddle hub, wherein an angle between each of the blades is 45 degrees.

The apparatus may further include: three flat blade assemblies on the at least one rotating drive shaft; four angled blade assemblies on the at least one rotating drive shaft; and one paddle assembly on the at least one rotating drive shaft.

The apparatus may further include a first chamber and a second chamber. The first and second chambers may be coupled so that a portion of the material passing through the intake passes into the first chamber and another portion of the material passing through the intake passes into the second chamber. The apparatus may further include a first rotatable drive shaft in the first chamber, a second rotatable drive shaft in the second chamber, at least one first blade assembly rotating in a first direction and comprising a first blade hub on the first rotatable drive shaft and at least one first blade, and at least one second blade assembly rotating in a second direction and comprising a second blade hub on the second rotatable drive shaft and at least one second blade. A portion of the at least one first blade may be adjacent a portion of the at least one second blade. A portion of the material may be transported from the first chamber to the second chamber and another portion of the material may be transported from the second chamber to the first chamber as the first and second blade assemblies rotate. The at least one first blade and at least one second blade may be adapted to pre-break the material between the at least one first blade and at least one second blade.

An outer end of the at least one blade may rotate at a velocity in a range from about 6000 feet per minute to about 11000 feet per minute.

The velocity of the warm air in the intake may be in a range from about 4000 feet per minute to about 6000 feet per minute. The velocity of the warm air at the angled blade assembly may be in a range from about 400 feet per minute to about 600 feet per minute. The velocity of the warm air at the paddle assembly may be in a range from about 4000 feet per minute to 6000 feet per minute.

The at least one chamber further comprises grinding bars on an interior wall of the chamber adapted to disrupt rotational air flow and material flow, and transport the material into a path of the at least one blade and powderize the fuel.

The grinding bars may be about ¾ inch by about ¾ inch and are spaced about one inch apart on the interior wall. The grinding bars may be at a seven degree angle to the longitudinal axis of the at least one rotatable drive shaft.

Another embodiment of the present invention provides a method for drying and powderizing material. The method includes: feeding warm air and material through an intake to at least one chamber; pre-breaking the material in the warm air by rotating at least one blade assembly on at least one rotatable drive shaft adapted to be rotated through the material, the blade assembly comprising a blade hub and at least one blade, wherein the at least one blade is adapted to pre-break the material to expose a surface of the material to the warm air so that the moisture in the material evaporates into the warm air; and transporting warm air and powder out of the at least one chamber through an outlet.

The powderizing of the material may further include: pre-breaking the material between at least one flat blade assembly and at least one fixed blade on an interior wall of the at least one chamber, wherein the flat blade assembly comprises a flat blade hub about the at least one rotatable drive shaft, and at least one flat blade adjacent to the at least one fixed blade and adapted to pre-break the material. The powderizing of the material may further include: powderizing the material and transporting the material through the at least one chamber by rotating at least one angled blade assembly through the material, wherein the at least one blade assembly comprises an angled blade hub about the at least one rotatable drive shaft and at least one rotating angled blade. The powderizing of the material may further include accelerating the material and transporting the material through the outlet by rotating at least one paddle assembly through the powder, wherein the paddle assembly comprises a paddle hub about the at least one rotatable drive shaft and at least one paddle adapted to accelerate and transport the powder.

The flat blade assembly may include twelve flat blades on the flat blade hub, wherein an angle between the blades is 30 degrees. The angled blade assembly may include twelve blades on the angled blade hub and at an angle of seven degrees to the longitudinal axis of the at least one rotatable drive shaft, wherein an angle between the blades is 30 degrees. The paddle assembly may include 8 paddles on the paddle hub, wherein an angle between the blades is 45 degrees.

Three flat blade assemblies may be on the at least one rotatable drive shaft. Four angled blade assemblies may be on the at least one rotatable drive shaft. One paddle assembly may be on the at least one rotatable drive shaft.

The at least one chamber may include a first chamber and a second chamber, wherein the first and second chambers are coupled so that a portion of the material passing through the intake passes into the first chamber and another portion of the material passing through the intake passes into the second chamber, a first rotatable drive shaft in the first chamber; a second rotatable drive shaft in the second chamber; at least one first blade assembly rotating in a first direction and comprising a first blade hub on the first rotatable drive shaft and at least one first blade; at least one second blade assembly rotating in a second direction and comprising a second blade hub on the second rotatable drive shaft and at least one second blade, wherein a portion of the at least one first blade is adjacent a portion of the at least one second blade, wherein a portion of the material is transported from the first chamber to the second chamber and another portion of the material is transported from the second chamber to the first chamber as the first and second rotating blade assemblies rotate, and wherein the at least one first and second blades are adapted to pre-break the material between the at least one first and second blades.

DETAILED DESCRIPTION

Figure 1:
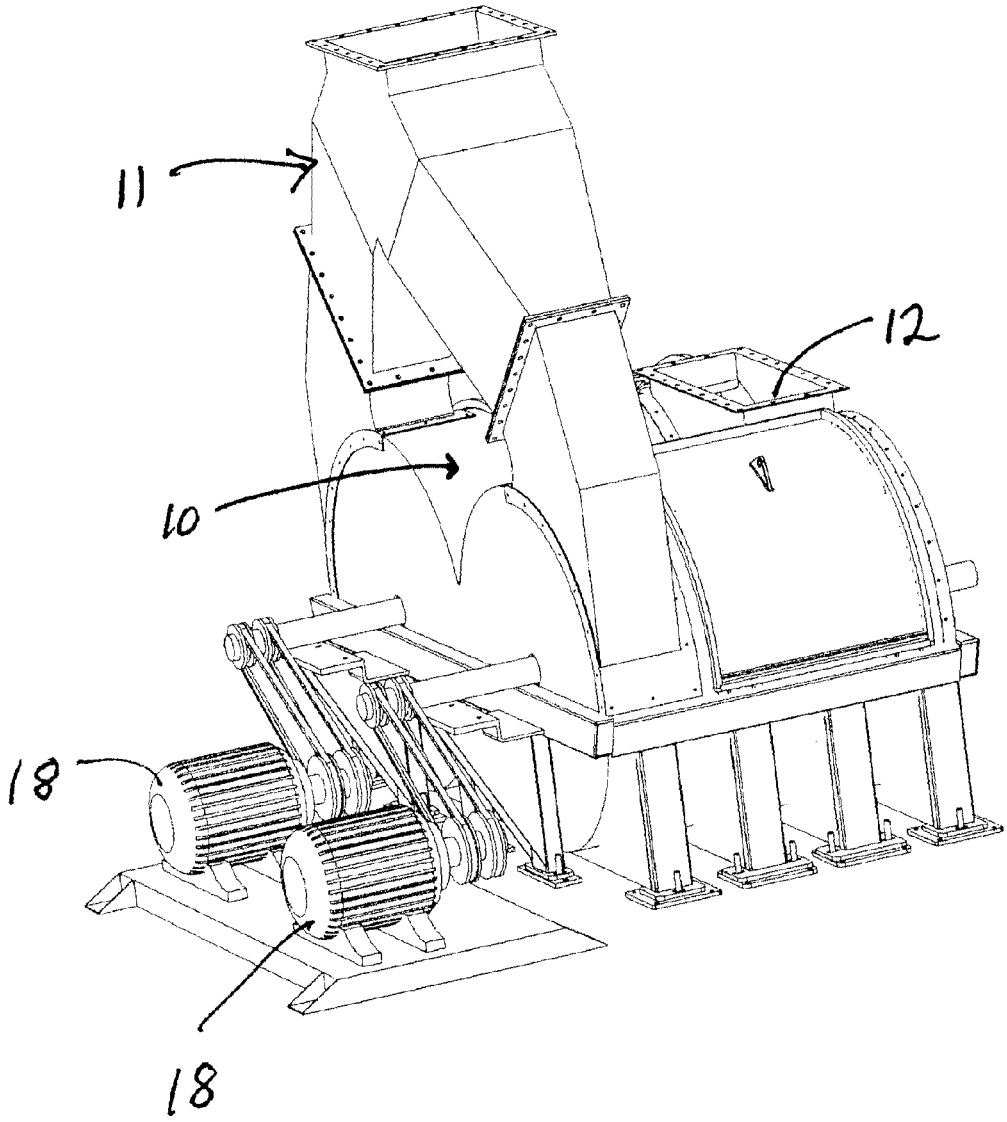
FIG. 1 is a perspective view of an apparatus for drying and powderizing material according to an embodiment of the present invention.
Figure 2:
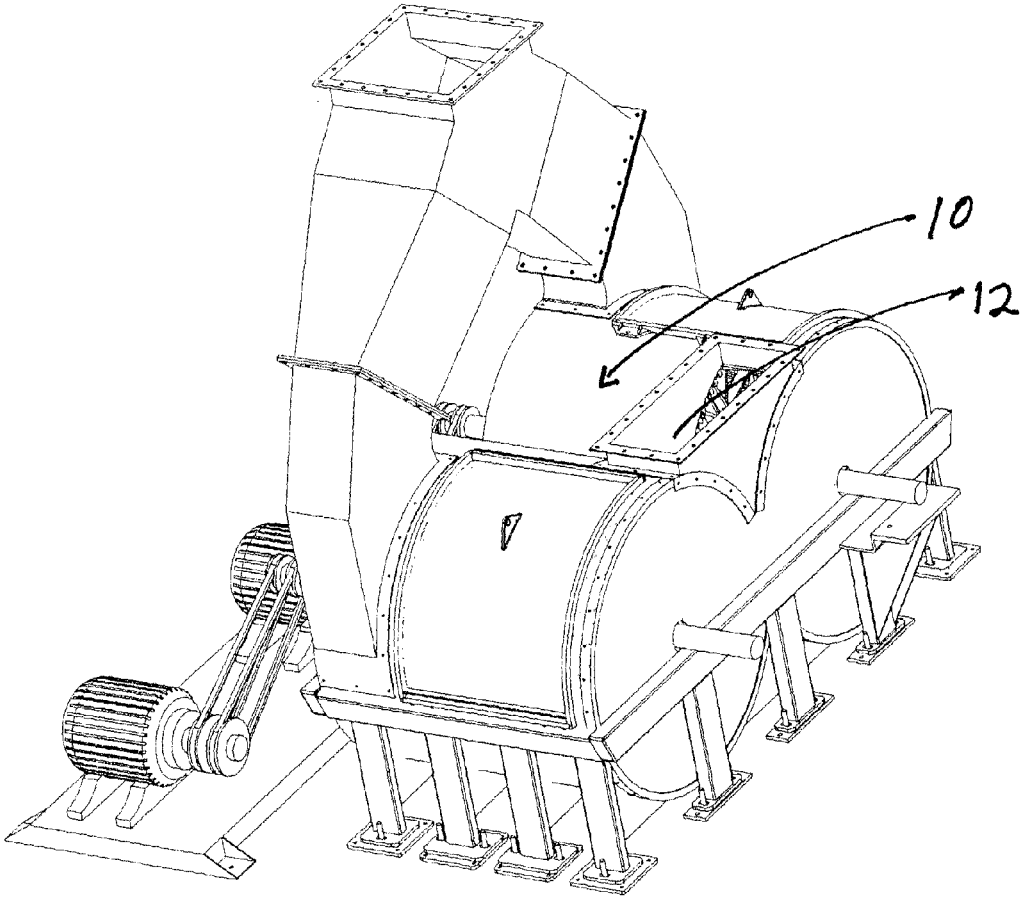
FIG. 2 is another perspective view of an embodiment of the present invention.
Figure 3:
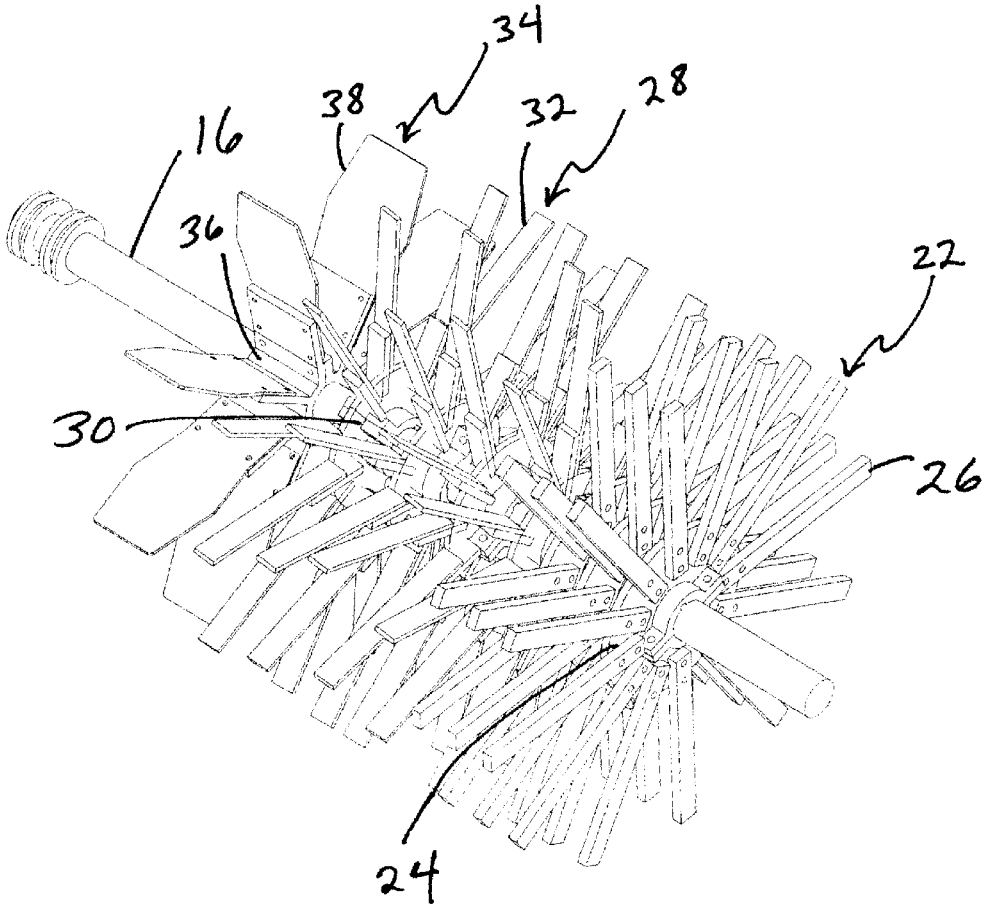
FIG. 3 is a perspective view of blade assemblies according to an embodiment of the present invention.

The detailed description set forth below in connection with the drawings is intended as a description of embodiments of a process and apparatus for drying and powderizing material in accordance with the present invention and is not intended to represent the only forms in which the invention may be constructed or utilized. It is to be understood that the same or equivalent functions and structures may be accomplished by different embodiments that are also intended to be encompassed within the spirit and scope of the invention. As denoted elsewhere herein, like element numbers indicate like elements or features.

Some biological or organic waste materials, such as animal byproduct meals, fecal material, agricultural fertilizer, corn byproducts, wheat byproducts, wood chips, saw dust, blood, bio-solids, milk powder, lime, coal, seaweed, are a rich source of energy when they are in a dry state. However, animal meal contains a high level of moisture. Further, sewage is transported in water and this water must be removed by pressing the sewage, and the solids that remain after the pressing still contain about 70% to about 80% moisture and about 20% solids by weight. Corn byproducts, wheat byproducts, and wood pulp are other examples of materials that are a good source of energy but generally contain too much moisture to be useable as fuel in their raw state. These materials (or raw fuel) must be dried to about 5% moisture to be a high grade fuel. A large quantity of high temperature air is required to evaporate the moisture from the material.

A process for converting the moisture-laden material into dry powder according to an embodiment of the present invention includes breaking the material into powder in the presence of warm fresh air so that moisture in the material quickly evaporates into the warm fresh air.

According to an embodiment of the present invention as shown in FIGS. 1-6, an apparatus for drying and powderizing material includes a chamber 10, which may be formed of any suitable material, such as 12 mm malleable steel, which is resistant to high temperatures and corrosion. Warm fresh air and the material enter the chamber 10 through a chamber entrance 12. For example, the fresh air may be warmed to a temperature of about 600 degrees C. for materials such as sewage. Dry powder leaves the chamber 10 through an outlet 11.

In an embodiment of the present invention, the material is fed into the apparatus with a center-less auger at a rate of about 9 cubic feet per minute to about 12 cubic feet per minute.

In an embodiment of the present invention, warm fresh air is fed into the apparatus at a rate of about 9,000 cubic feet per minute. However, one of ordinary skill in the art will appreciate that the apparatus may be optimized for different desired rates of processing material, and that the flow rate of the warm fresh air may be adjusted accordingly.

Inside the chamber 10, at least one rotating blade assembly (22 or 28) breaks the material into a powder (e.g., pre-break and/or powderize the material). For example, the material may be broken into a powder with a consistency resembling talcum powder.

The blade assembly (22 or 28) includes at least one blade (26 or 32) and a blade hub (24 or 30), where the blade hub (24 or 30) is mounted on a drive shaft 16, which may be hollow or solid stock mild steel or any other suitable material, rotated by a motor 18.

In an embodiment of the present invention, the drive shaft 16 has a diameter of about 2 inches to about 6 inches.

In an embodiment of the present invention, the chamber 10 is sealed about the drive shaft 16 so that material and air do not escape from the chamber.

Figure 4:
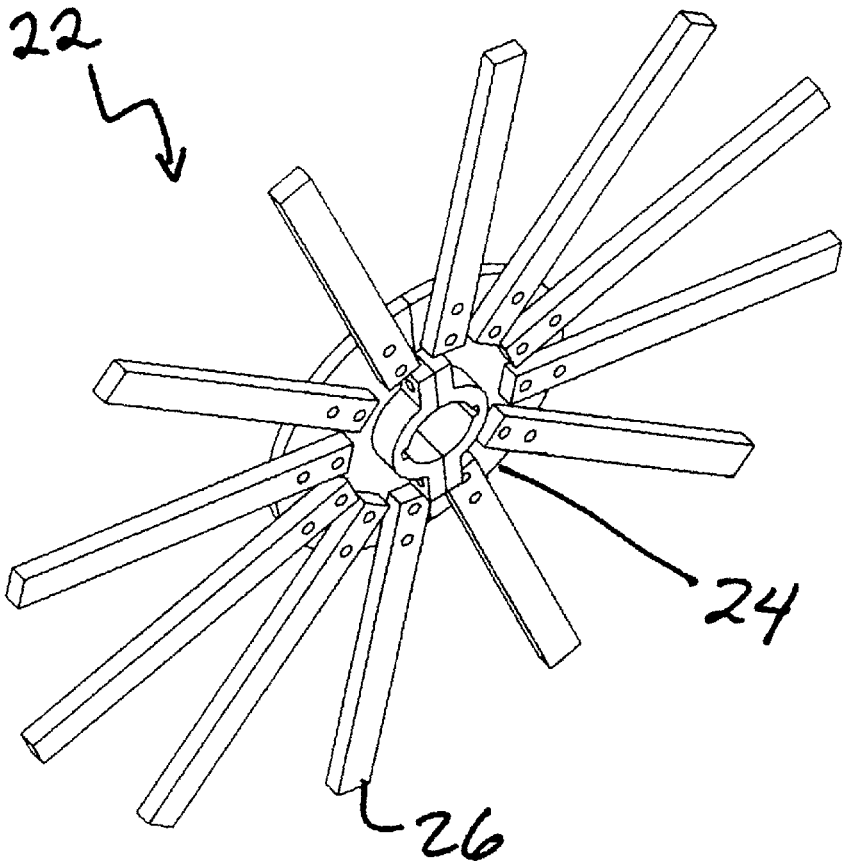
FIG. 4 is a perspective view of a flat blade assembly according to an embodiment of the present invention.

In an embodiment of the present invention, the apparatus includes at least one flat blade assembly 22 and at least one angled blade assembly 28. As shown in FIG. 4, the flat blade assembly includes a flat blade hub 24 and at least one flat blade 26, for shearing the material, attached to the flat blade hub 24. For example, there may be twelve flat blades 26 attached to the flat blade hub 24 so that the angle between the flat blades 26 is about 30 degrees, and there may be three flat blade assemblies 22 on a drive shaft 16.

Figure 5:
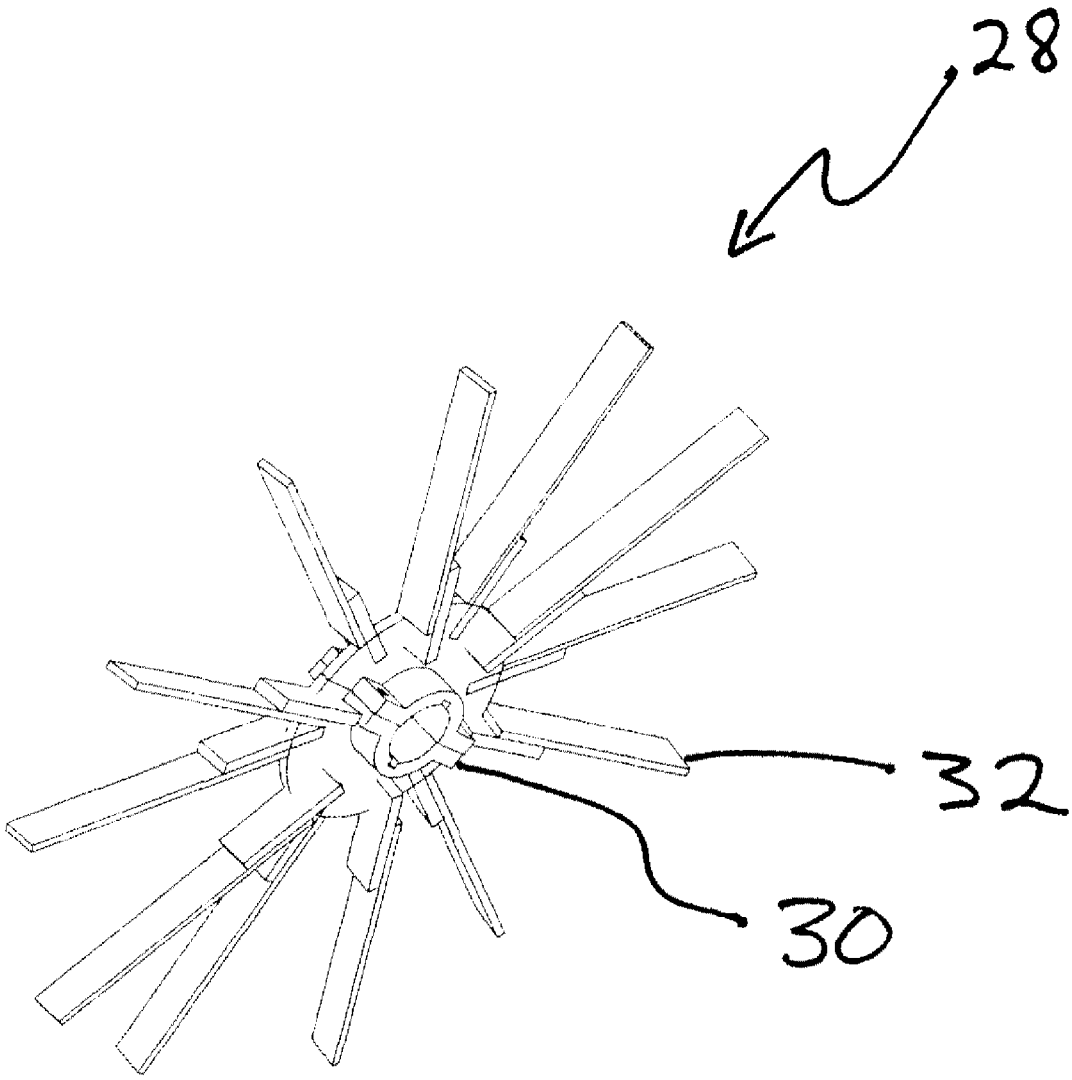
FIG. 5 is a perspective view of an angled blade assembly according to an embodiment of the present invention.

In an embodiment of the present invention shown in FIG. 5, the angled blade assembly 28 includes an angled blade hub 30 and at least one angled blade 32, for shearing the material and transporting the material through the chamber 10, attached to the angled blade hub 30. For example, there may be twelve angled blades 32 attached to the angled blade hub 30 so that the angle between the angled blades 32 is about 30 degrees. Further, there maybe four angled blade assemblies 28 on a drive shaft 16, and the angled blade assemblies 28 may be mounted so that angled blades 32 from adjacent angled blade assemblies 28 are offset from each other by about 10 degrees. In an embodiment of the present invention, the angled blades 32 are mounted on the angled blade hub 30 at an angle of seven degrees to the longitudinal axis of the drive shaft 16.

In an embodiment of the present invention, the outer tips of the blades 26, 32 are moving at about 6000 feet per minute to about 11000 feet per minute.

In an embodiment of the present invention, the air passing through the angled blades 32 has a velocity of about 400 feet per minute to about 600 feet per minute.

Figure 6:
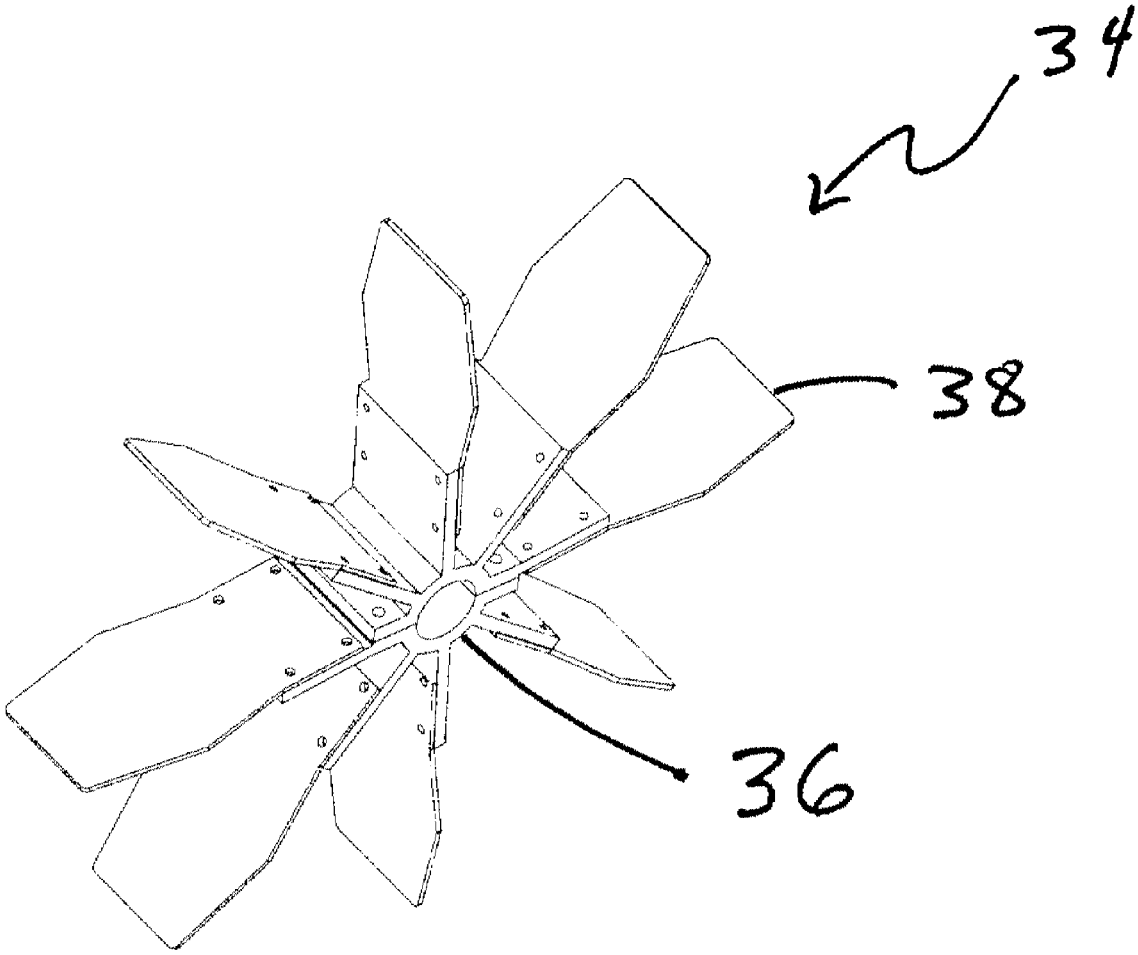
FIG. 6 is a perspective view of a paddle assembly according to an embodiment of the present invention.

In an embodiment of the present invention as shown in FIG. 6, the apparatus includes a paddle assembly 34 on the drive shaft that accelerates the powder and moves the powder out of the apparatus. The paddle assembly 34 includes a paddle hub 36 and at least one paddle 38, for accelerating the powder and transporting the powder out of the chamber 10, attached to the paddle hub 36. For example, there may be eight paddles 38 attached to the paddle hub 36, and the angle between the paddles is about 45 degrees.

In an embodiment of the present invention, the air passing through the paddles 38 has a velocity of about 4000 feet per minute to about 6000 feet per minute.

Figure 7:
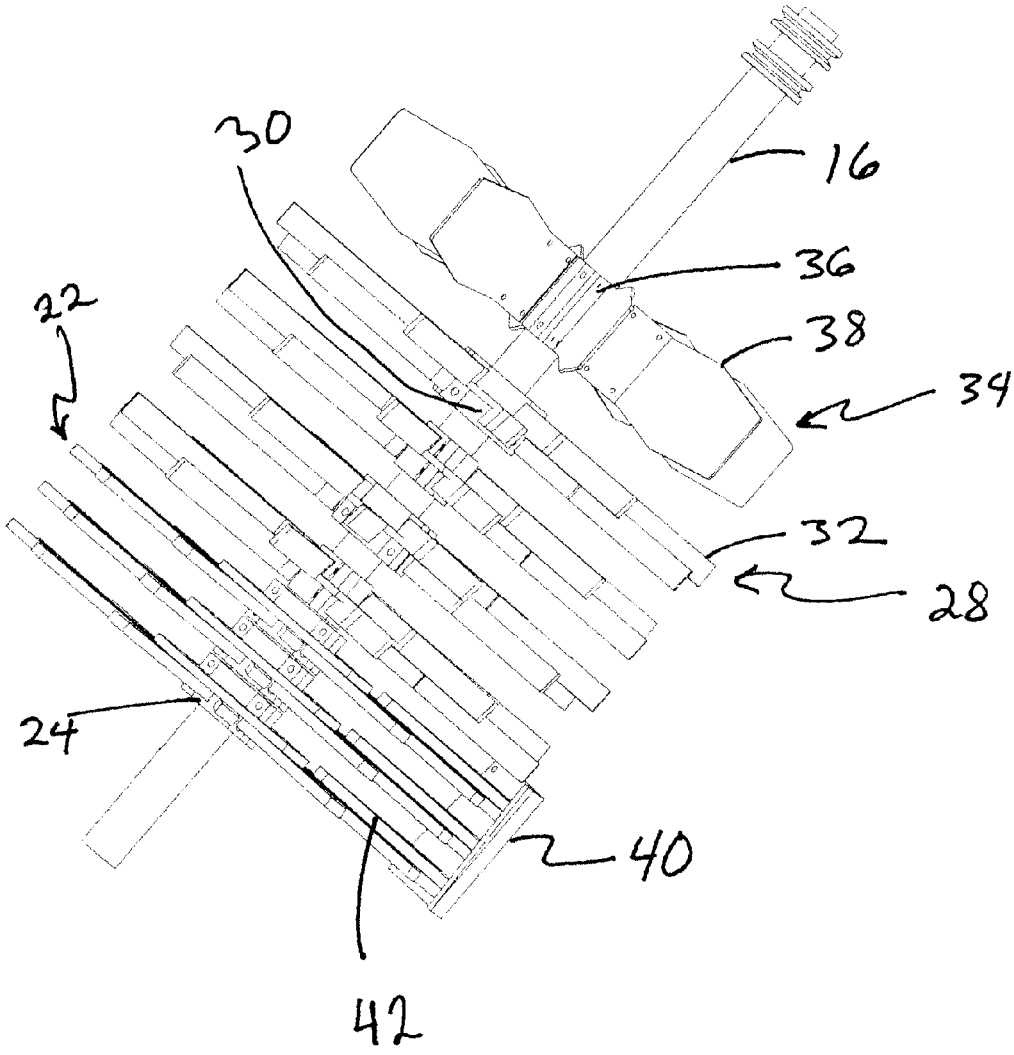
FIG. 7 is a top view of blade assemblies according to another embodiment of the present invention.
Figure 8:
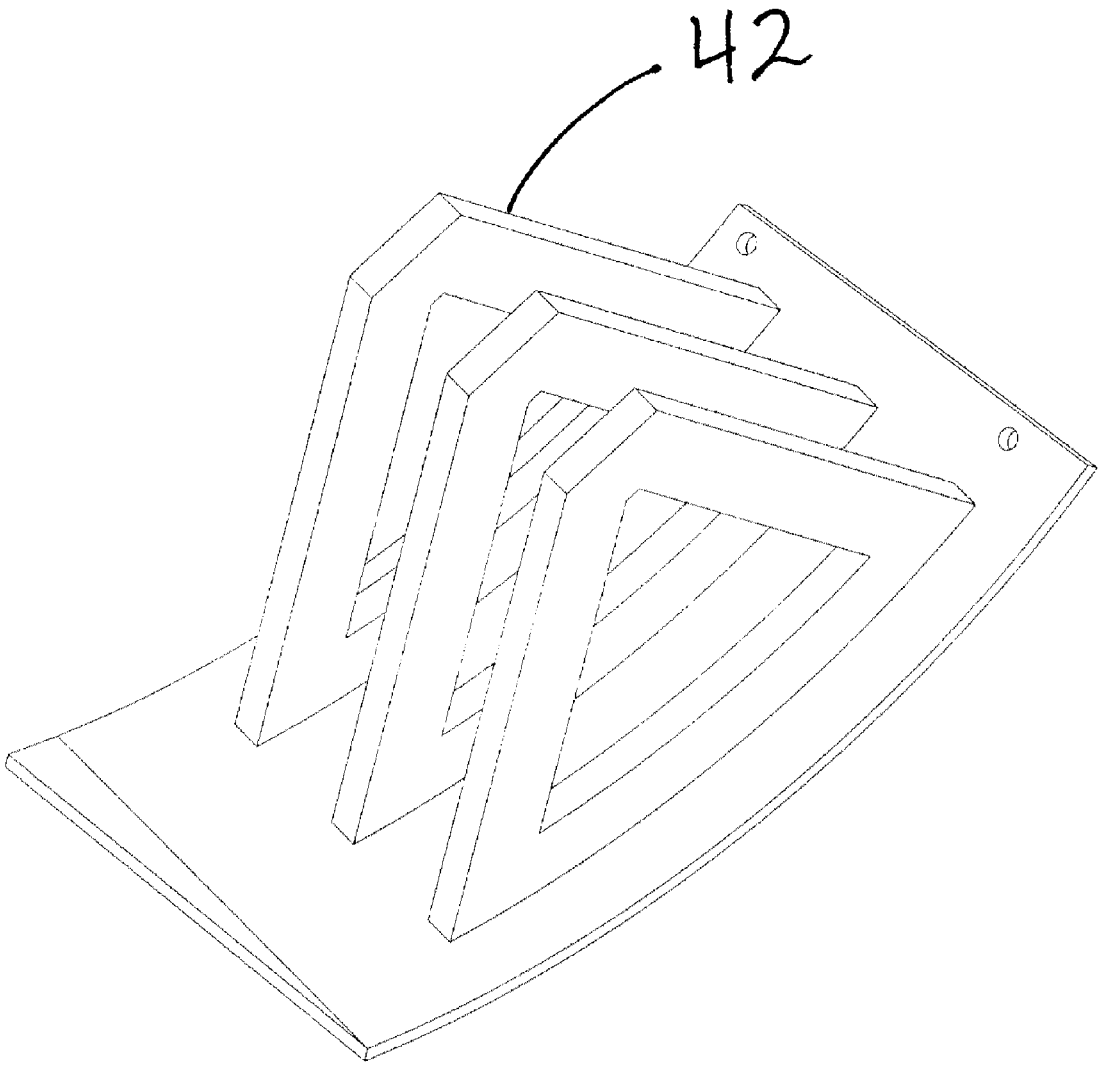
FIG. 8 is a perspective view of a fixed blade assembly according to an embodiment of the present invention.
Figure 9:
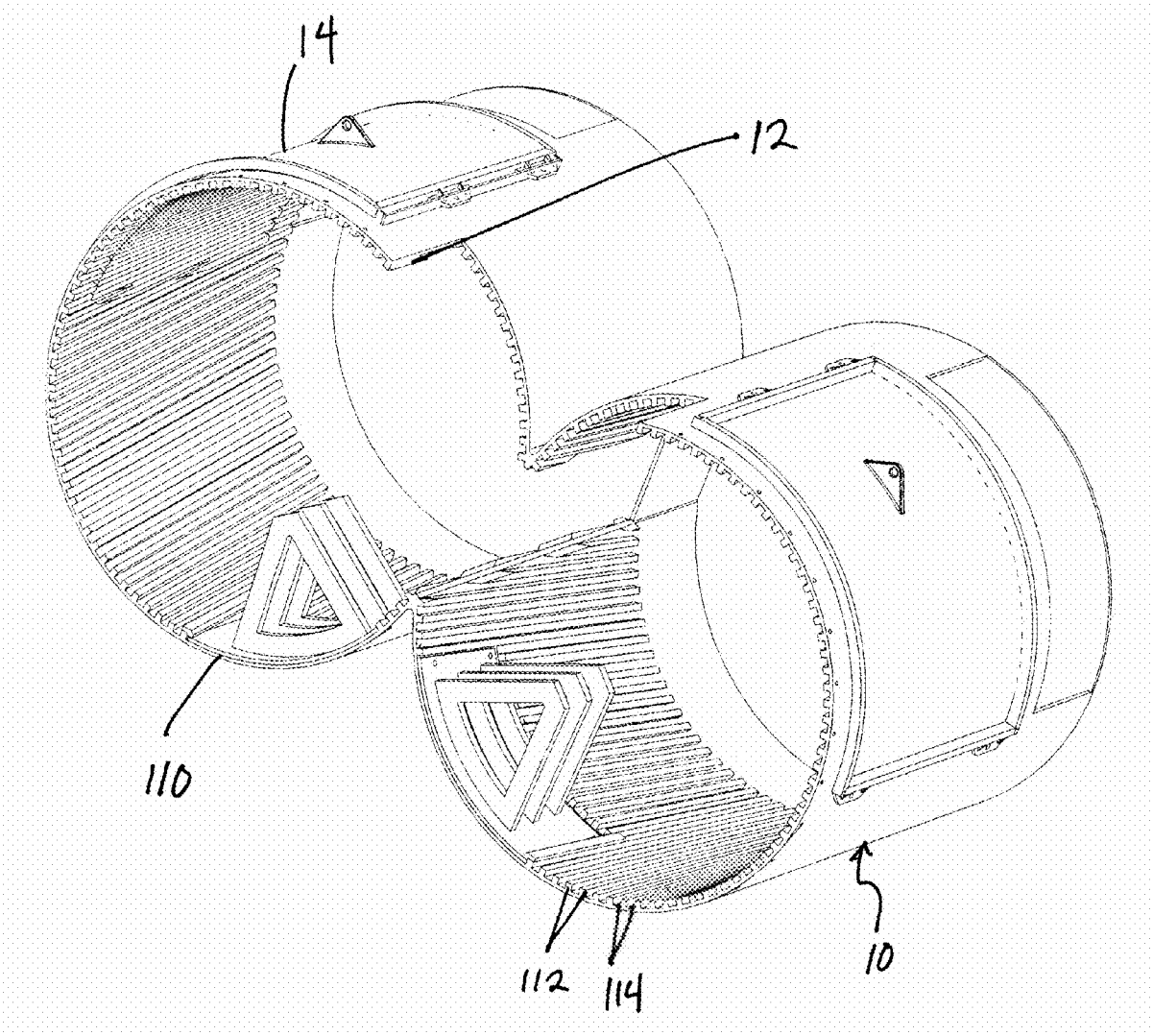
FIG. 9 is a perspective view of a chamber according to an embodiment of the present invention.

In an embodiment of the present invention shown in FIGS. 7 and 8, the apparatus also includes at least one fixed blade assembly 40. The fixed blade assembly 40 includes at least one fixed blade 42. For example, the fixed blade assembly 40 may include three fixed blades 42. The fixed blade assembly 40 is positioned on an interior wall 110 of the chamber 10, as shown in FIG. 9. The fixed blades 42 are adjacent to a portion of the rotating flat blades 26 so that as the rotating flat blades 26 rotate past the fixed blades 42, the material is sheared between the blades 26, 42.

In an embodiment of the present invention, the fixed blade 42 includes two sections that are attached to each other at a 57 degree angle. In an embodiment of the present invention, the fixed blades, forming two sides of the triangular formation, are about 40 mm wide and 25 mm thick.

In an embodiment of the present invention shown in FIG. 9, grinding bars 112 are positioned on an interior wall of the chamber 10 with spaces 114 between the grinding bars 112. The grinding bars 112 further shear the material as the material is pushed against the interior wall 110 of the chamber 10. Also, the grinding bars 112 prevent or reduce build-up of the material on interior wall of the chamber 10. For example, the grinding bars 112, which may be cut from square mild steel rod or any other suitable material, may be about ¾ inch by about ¾ inch. Also, the grinding bars 112 may be uniformly spaced along the interior wall of the chamber 10, e.g., about one inch apart.

In an embodiment of the present invention, the grinding bars 112 are positioned along the interior wall of the chamber 10 at an angle of about seven degrees to the longitudinal axis of the drive shaft 16.

In an embodiment of the present invention, the distance between the grinding bars 112 and the tips of the blades 26, 32 is about 30 mm.

In an embodiment of the present invention, the grinding bars 112 promote warm air movement in an axial direction and discourage rotational circulation through the chamber 10. Here, because both the grinding bars 112 and the angled blades 32 are set at the same angle of seven degrees, the discharge from the tip of each of the angled blades 32 will follow the taper of the grinding bars, which will prevent or reduce build up of material on the interior walls of the chamber 10.

In an embodiment of the present invention, there are two chambers 10 that are in communication with each other. Each chamber has a drive shaft with rotating blade assemblies 22, 28 and/or a paddle assembly 34. Here, the inlet 12 allows material to be fed into both chambers 10 at the same time, so that some of the material falls into one chamber and some of the material falls into the other chamber. Further, as the rotating blades 26, 32 shear and move the material, portions of the material move from one chamber to the other.

In an embodiment of the present invention, the first rotating blade assemblies 22, 28 on a drive shaft 16 in a first chamber 10 rotate in one direction, e.g., clockwise, and second rotating blade assemblies 22, 28 on a drive shaft 16 in the other second chamber 10 rotate in a second direction, e.g., counterclockwise, opposite the first direction.

In an embodiment of the present invention, the material is exposed to a double axial and radial motion within the turbulence created between the communicating chambers 10.

In an embodiment of the present invention, portions of the first and second rotating blade assemblies 22, 28 rotate past each other so that the material is sheared and powderized between the first and second rotating blade assemblies 22, 28 and material moves between the first and second chambers 10.

In an embodiment of the present invention, the surface area of the powder is about 3000 times the surface area of the material as it enters the apparatus. The increase in surface area varies with the type of material being processed, thus air flow and temperatures are adjusted accordingly.

In an embodiment of the present invention, the warm air in the apparatus may contain contaminants from the material, such as pathogens and the like, and should be contained to prevent escape to the atmosphere. Here, the apparatus is sealed so that the contaminated warm air does not escape to atmosphere. Warm fresh air is blown into the inlet 12, which prevents or reduces contaminated air from traveling to the atmosphere through the inlet 12. Further, the outlet 11 may be sealed to a conduit that either contains the contaminated air or transports the contaminated air to another apparatus so that the contaminated air may be treated.

In an embodiment of the present invention, the material moves through the apparatus in about 15 seconds.

In an embodiment of the present invention where the material is sewage, the powder from the apparatus combusts at about 1100 degrees C. Once the powder is combusted, the ash left behind is basically sand, which may be utilized for landscaping or making glass or bricks.

For example, the composition of the sand was experimentally found to be as follows:

| | |
|---|---|
| $SiO_2$ | 61.4% |
| $Al_2O_3$ | 14.1% |
| $Fe_2O_3$ | 5.5% |
| CaO | 4.1% |
| MgO | 1.7% |
| $Na_2O$ | 3.4% |
| $K_2O$ | 1.7% |
| $TiO_2$ | 1.0% |
| $Mn_3O_4$ | 0.10% |
| $SO_3$ | 0.30% |
| $P_2O_5$ | 4.10% |

In an embodiment of the present invention where the material is sewage, the volume of the sewage is reduced to about 3% to 7% of the original volume.

In an embodiment of the present invention, the powder and warm air passes from the apparatus to a filter so that the powder is filtered from the warm air.

In an embodiment of the present invention, a heat dissipater (or heat slinger) is attached to the drive shaft 16 so that excess heat from the drive shaft 16 is discharged to the atmosphere.

In an embodiment of the present invention, the acceleration of the warm air and the powder through the apparatus reduces the pressure loss across the apparatus by 60%.

In the apparatus, the material is broken into a powder that resembles talcum powder. For example, the particles of the powder may be a size where about 80% of the particles will be smaller than 76 microns (or 200 mesh). This breaking of the material takes place in the presence of the warm fresh air so that the moisture in the material evaporates into the warm fresh air as the material is broken into powder. In an embodiment of the present invention, powder leaving the apparatus has about 3% to 7% moisture.

Although the present invention has been described through the use of exemplary embodiments, it will be appreciated by those of skill in the art that various modifications may be made to the described embodiments that fall within the scope and spirit of the invention as defined by the claims and their equivalents appended hereto. For example, aspects shown above with particular embodiments may be combined with or incorporated into other embodiments.

What is claimed is:

1. An apparatus for drying and powderizing material, the apparatus comprising:

at least one chamber comprising:

an intake adapted to receive warm air and material into the at least one chamber;

an outlet adapted to transport warm air and powderized material out of the at least one chamber;

at least one flat blade assembly on at least one rotatable drive shaft, the at least one flat blade assembly comprising a flat blade hub about the at least one rotatable drive shaft and at least one flat blade coupled to the flat blade hub, wherein the at least one flat blade assembly is positioned to receive the material from the intake and pre-break the material to expose a surface of the material to the warm air so that moisture in the material evaporates into the warm air;

at least one fixed blade assembly on an interior wall of the at least one chamber and adjacent to the at least one flat blade, wherein the at least one fixed blade assembly comprises at least one fixed blade and is positioned to pre-break the material between the at least one flat blade and the at least one fixed blade;

at least one angled blade assembly on the at least one rotatable drive shaft, the angled blade assembly comprising an angled blade hub about the at least one rotatable drive shaft and at least one angled blade coupled to the angled blade hub, wherein the at least one angled blade assembly is positioned to receive the pre-broken material from the at least one flat blade assembly, to transport the pre-broken material through the at least one chamber, and to powderize the pre-broken material; and at least one paddle assembly on the at least one rotatable drive shaft, the paddle assembly comprising a paddle hub about the at least one rotatable drive shaft and at least one paddle coupled to the paddle hub, wherein the at least one paddle assembly is positioned to receive the powderized material from the at least one angled blade assembly, to accelerate the powderized material, and to transport the powderized material through the outlet, wherein the at least one flat blade has a wide flat surface that is perpendicular to the drive shaft, wherein the at least one paddle has a wide paddle surface that is parallel to the drive shaft, and wherein the angled blade has a wide angled surface that has an angle to a longitudinal axis of the at least one rotatable drive shaft that is between that of the wide flat surface and the wide paddle surface.

2. The apparatus of claim 1, wherein the at least one flat blade assembly comprises twelve flat blades on the flat blade hub, wherein an angle between each of the flat blades is 30 degrees;

wherein the at least one angled blade assembly comprises twelve angled blades on the angled blade hub at an angle of seven degrees to the longitudinal axis of the at least one rotatable drive shaft, wherein an angle between each of the angled blades is 30 degrees; and wherein the at least one paddle assembly comprises 8 paddles on the paddle hub, wherein an angle between each of the blades is 45 degrees.

3. The apparatus of claim 1 further comprising:

three flat blade assemblies on the at least one rotatable drive shaft;

four angled blade assemblies on the at least one rotatable drive shaft; and one paddle assembly on the at least one rotatable drive shaft.

4. The apparatus of claim 1, wherein an outer end of the at least one blade rotates at about 6000 feet per minute to about 11000 feet per minute.

5. The apparatus of claim 1, wherein the velocity of the warm air in the intake is in a range from about 4000 feet per minute to about 6000 feet per minute;

wherein the velocity of the warm air at the angled blade assembly is in a range from about 400 feet per minute to about 600 feet per minute; and wherein the velocity of the warm air at the paddle assembly is in a range from about 4000 feet per minute to about 6000 feet per minute.

6. The apparatus of claim 1, wherein the at least one chamber further comprises grinding bars on an interior wall of the chamber adapted to discourage rotational movement of the material and the transporting air flow, and transport the material into a path of the at least one blade and powderize the fuel.

7. The apparatus of claim 6, wherein the grinding bars are about ¾ inch by about ¾ inch and are spaced about one inch apart on the interior wall.

8. The apparatus of claim 6, wherein the grinding bars are at a seven degree angle to the longitudinal axis of the at least one rotatable drive shaft.

9. A method for drying and powderizing material, the method comprising:

feeding warm air and material through an intake to at least one chamber;

pre-breaking the material from the intake between at least one flat blade assembly and at least one fixed blade assembly on an interior wall of the at least one chamber, wherein the flat blade assembly comprises a flat blade hub about at least one rotatable drive shaft and at least one flat blade adjacent to the at least one fixed blade adapted to pre-break the material, and wherein the fixed blade assembly comprises at least one fixed blade adapted to pre-break the material;

powderizing and transporting the pre-broken material from the at least one flat blade assembly through the at least one chamber by rotating at least one angled blade assembly through the pre-broken material, wherein the at least one angled blade assembly comprises an angled blade hub about the at least one rotatable drive shaft and at least one rotating angled blade adapted to powderize and transport the pre-broken material; and accelerating and transporting the powderized material from the at least one angled blade assembly through an outlet by rotating at least one paddle assembly through the powderized material, wherein the paddle assembly comprises a paddle hub about the at least one rotatable drive shaft and at least one paddle adapted to accelerate and transport the powderized material, wherein the at least one flat blade has a wide flat surface that is perpendicular to the drive shaft, wherein the at least one paddle has a wide paddle surface that is parallel to a longitudinal axis of the at least one rotatable drive shaft, and wherein the angled blade has a wide angled surface that has an angle to the drive shaft that is between that of the wide flat surface and the wide paddle surface.

10. The method of claim 9, wherein the pre-breaking the material step comprises pre-breaking the material between the at least one flat blade assembly and the at least one fixed blade, wherein the at least one flat blade assembly comprises twelve flat blades on the flat blade hub, wherein an angle between the blades is 30 degrees;

wherein the powderizing and transporting the pre-broken material step comprises powderizing and transporting the pre-broken material by rotating the at least one angled blade assembly through the material, wherein the angled blade assembly comprises twelve angled blades on the angled blade hub and at an angle of seven degrees to the longitudinal axis of the at least one rotatable drive shaft, wherein an angle between the blades is 30 degrees; and wherein the accelerating and transporting the powderized material step comprises accelerating and transporting the powderized material by rotating the at least one paddle assembly through the powderized material, wherein the rotating paddle assembly comprises 8 paddles on the paddle hub, wherein an angle between the blades is 45 degrees.

11. The method of claim 9, wherein the pre-breaking the material step further comprises pre-breaking the material between the at least one flat blade assembly and the at least one fixed blade, wherein three rotating flat blade assemblies are on the at least one rotatable drive shaft; wherein the powderizing and transporting the pre-broken material step further comprises powderizing and transporting the pre-broken material by rotating the at least one angled blade assembly through the pre-broken material, wherein four rotating angled blade assemblies are on the at least one rotatable drive shaft; and wherein the accelerating and transporting the powderized material step comprises accelerating and transporting the powderized material by rotating the at least one paddle assembly through the powderized material, wherein one rotating paddle assembly is on the at least one rotatable drive shaft.

12. The method of claim 9, wherein the powderizing and transporting the pre-broken material step comprises rotating the at least one angled blade, wherein an outer end of the at least one angled blade rotates at about 6000 feet per minute to 11,000 feet per minute.

13. The method of claim 9, wherein the pre-breaking the material step further comprises pre-breaking the material between the at least one flat blade assembly and the at least one fixed blade, wherein the velocity of the warm air in the intake ranges from about 4000 feet per minute to about 6000 feet per minute;

wherein the powderizing and transporting the pre-broken material step further comprises powderizing and transporting the pre-broken material by rotating the at least one angled blade assembly through the material, wherein the velocity of the warm air at the at least one angled blade assembly ranges from about 200 feet per minute to about 400 feet per minute; and wherein the accelerating and transporting the powderized material step comprises accelerating and transporting the powderized material by rotating the at least one paddle assembly through the powder, wherein the velocity of the warm air at the at least one paddle assembly ranges from about 4000 feet per minute to about 6000 feet per minute.

14. The method of claim 9, wherein the powderizing and transporting the pre-broken material step further comprises powderizing and transporting the pre-broken material via grinding bars on the interior wall of the chamber adapted to transport the pre-broken material into a path of the at least one angled blade and powderize the pre-broken material.

15. The method of claim 14, wherein the powderizing and transporting the pre-broken material step further comprises powderizing and transporting the pre-broken material via the grinding bars, wherein the grinding bars are about ¾ inch by about ¾ inch and are spaced about one inch apart on the interior wall.

16. The method of claim 14, wherein the powderizing and transporting the pre-broken material step further comprises powderizing and transporting the pre-broken material via the grinding bars, wherein the grinding bars are at a seven degree angle to the longitudinal axis of the at least one rotatable drive shaft.

17. An apparatus for drying and powderizing material, the apparatus comprising:

an intake adapted to receive warm air and material;

a first chamber and a second chamber, wherein the first and second chambers are coupled so that a portion of the material passing through the intake passes into the first chamber and another portion of the material passing through the intake passes into the second chamber;

a first rotatable drive shaft in the first chamber;

a second rotatable drive shaft in the second chamber;

at least one first blade assembly on the first rotatable drive shaft rotating in a first direction and comprising a first blade hub about the first rotatable drive shaft and at least one first blade with a wide first surface that has an angle that is between being parallel and being perpendicular to a longitudinal axis of the first rotatable drive shaft, and coupled to the first blade hub, wherein the at least one first blade is adapted to powderize the material to expose a surface of the material to the warm air so that moisture in the material evaporates into the warm air;

at least one second blade assembly on the second rotatable drive shaft rotating in a second direction and comprising a second blade hub about the second rotatable drive shaft and at least one second blade with a wide second surface that has an angle that is between being parallel and being perpendicular to a longitudinal axis of the second rotatable drive shaft, and coupled to the second blade hub, wherein the at least one second blade is adapted to powderize the material to expose a surface of the material to the warm air so that moisture in the material evaporates into the warm air; and an outlet adapted to transport warm air and powder out of the first and second chambers, wherein a portion of the at least one first blade is adjacent a portion of the at least one second blade, wherein a portion of the material is transported from the first chamber to the second chamber and another portion of the material is transported from the second chamber to the first chamber as the first and second blade assemblies rotate, and wherein the at least one first blade and at least one second blade are adapted to powderize the material between the at least one first blade and at least one second blade.

18. A method for drying and powderizing material, the method comprising:

feeding warm air and material through an intake to at least one chamber, wherein the at least one chamber comprises:

a first chamber and a second chamber, wherein the first and second chambers are coupled so that a portion of the material passing through the intake passes into the first chamber and another portion of the material passing through the intake passes into the second chamber;

a first rotatable drive shaft in the first chamber;

a second rotatable drive shaft in the second chamber;

at least one first blade assembly rotating in a first direction and comprising a first blade hub on the first rotatable drive shaft and at least one first blade, wherein the at least one first blade has a wide first surface that has an angle that is between being parallel and being perpendicular to a longitudinal axis of the first rotatable drive shaft, and is adapted to powderize the material to expose a surface of the material to the warm air so that the moisture in the material evaporates into the warm air;

at least one second blade assembly rotating in a second direction and comprising a second blade hub on the second rotatable drive shaft and at least one second blade, wherein the at least one second blade has a wide second surface that has an angle that is between being parallel and being perpendicular to a longitudinal axis of the second rotatable drive shaft, and is adapted to powderize the material to expose a surface of the material to the warm air so that the moisture in the material evaporates into the warm air;

powderizing the material in the wain air by rotating the at least one first blade and the at least one second blade through the material, wherein a portion of the at least one first blade is adjacent a portion of the at least one second blade, wherein a portion of the material is transported from the first chamber to the second chamber and another portion of the material is transported from the second chamber to the first chamber as the first and second rotating blade assemblies rotate, and wherein the at least one first and second blades are adapted to powderize the material between the at least one first and second blades; and transporting warm air and powderized material out of the at least one chamber through an outlet.

19. An apparatus for drying and powderizing material, the apparatus comprising:

at least one chamber comprising:

an intake adapted to receive warm air and material into the at least one chamber;

an outlet adapted to transport warm air and powder out of the at least one chamber;

at least one rotatable drive shaft in the at least one chamber adapted to be rotated; and at least one angled blade assembly on the at least one rotatable drive shaft, the at least one angled blade assembly comprising a blade hub about the at least one rotatable drive shaft and at least one angled blade coupled to the blade hub, wherein the at least one angled blade is adapted to powderize the material to expose a surface of the material to the warm air so that moisture in the material evaporates into the warm air, wherein the at least one angled blade has an angle to a longitudinal axis of the drive shaft between being parallel to the drive shaft and being perpendicular to the drive shaft.

20. The apparatus of claim 19, wherein the at least one angled blade assembly comprises twelve angled blades on the angled blade hub, and wherein an angle between each of the angled blades is 30 degrees.

21. The apparatus of claim 19, wherein the at least one angled blade is at an angle of seven degrees to the longitudinal axis of the at least one rotatable drive shaft.

22. An apparatus for drying and powderizing material, the apparatus comprising:

at least one chamber comprising:

an intake adapted to receive warm air and material into the at least one chamber;

an outlet adapted to transport warm air and powder out of the at least one chamber;

at least one rotatable drive shaft in the at least one chamber adapted to be rotated;

at least one blade assembly on the at least one rotatable drive shaft, the blade assembly comprising a blade hub about the at least one rotatable drive shaft and at least one blade coupled to the blade hub, wherein the at least one blade is adapted to powderize the material to expose a surface of the material to the warm air so that moisture in the material evaporates into the warm air, and at least one fixed blade assembly on an interior wall of the at least one chamber and adjacent to the at least one blade, wherein the fixed blade assembly comprises at least one fixed blade extending radially towards the at least one rotatable drive shaft and overlapping the at least one blade, and is positioned to pre-break the material between the at least one blade and the at least one fixed blade.

23. The apparatus of claim 22, wherein the at least one fixed blade comprising two sections attached to each other at a 57 degree angle.

* * * * *